US009011170B2

(12) United States Patent
Sauer et al.

(10) Patent No.: US 9,011,170 B2
(45) Date of Patent: Apr. 21, 2015

(54) DETACHABLE LID

(75) Inventors: Keith A. Sauer, Spring, TX (US); Kelly K Smith, Spring, TX (US); Robert J. Hastings, Spring, TX (US); Chong Sin Tan, Spring, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/823,916

(22) PCT Filed: Dec. 16, 2010

(86) PCT No.: PCT/US2010/060853
§ 371 (c)(1),
(2), (4) Date: Mar. 15, 2013

(87) PCT Pub. No.: WO2012/082130
PCT Pub. Date: Jun. 21, 2012

(65) Prior Publication Data

US 2013/0171858 A1 Jul. 4, 2013

(51) Int. Cl.

| | |
|---|---|
| ***H01R 13/62*** | (2006.01) |
| ***H01R 12/88*** | (2011.01) |
| ***H01R 43/26*** | (2006.01) |

(52) U.S. Cl.
CPC ..... *H01R 13/62* (2013.01); *Y10T 29/49117* (2015.01); *H01R 12/88* (2013.01); *H01R 43/26* (2013.01)

(58) Field of Classification Search
USPC ..... 439/331, 73, 330
IPC .... H05K 7/1023,7/1053, 7/1061; H01R 23/684
See application file for complete search history.

(56) References Cited

U.S. PATENT DOCUMENTS

| | | | | |
|---|---|---|---|---|
| 6,796,805 | B2 | 9/2004 | Murr | |
| 6,905,377 | B2 | 6/2005 | Murr | |
| 7,387,523 | B2 * | 6/2008 | Hsu | 439/331 |
| 7,429,182 | B1 * | 9/2008 | Zheng et al. | 439/135 |
| 7,438,580 | B1 | 10/2008 | Aoki et al. | |
| 7,604,486 | B2 | 10/2009 | Martinson et al. | |
| 7,717,729 | B2 * | 5/2010 | Zhang et al. | 439/331 |
| 7,749,014 | B2 * | 7/2010 | Chiang | 439/331 |
| 2004/0115966 | A1 | 6/2004 | Ma et al. | |
| 2006/0046530 | A1 | 3/2006 | Wang | |
| 2008/0045048 | A1 | 2/2008 | Ma | |
| 2008/0214025 | A1 | 9/2008 | Ziiang et al. | |
| 2010/0162561 | A1 | 7/2010 | Canham et al. | |
| 2010/0167572 | A1 | 7/2010 | Terhune, IV et al. | |

FOREIGN PATENT DOCUMENTS

| | | | |
|---|---|---|---|
| CN | 1407672 | A | 4/2003 |
| CN | 1761109 | A | 4/2006 |

OTHER PUBLICATIONS

International Searching Authority, The International Search Report and the Written Opinion, Sep. 28, 2011, 10 Pages.

* cited by examiner

*Primary Examiner* — Hien Vu
(74) *Attorney, Agent, or Firm* — Hewlett-Packard Patent Department

(57) ABSTRACT

A method and apparatus for mounting a semiconductor is disclosed. First, the semiconductor is mounted into the bracket of a lid while the lid is detached from a frame. Once the semiconductor has been loaded into the lid/bracket assembly, the loaded lid is mounted onto the frame. The lid is then locked in place on the frame by rotating a locking lever into a closed locked position.

10 Claims, 5 Drawing Sheets

DETACHABLE LID

BACKGROUND

Many integrated circuits (IC) are mounted to a printed circuit (PC) board using a socket. One type of socket is a land grid arrays (LGA) socket. Older style sockets have holes in the socket that mate with pins attached to the underside of an IC. LGA sockets have protruding pins or spring contacts which touch contact pads on the underside of an IC. LGA sockets typically do not require any insertion force when installing the IC into the socket. The IC is held into the socket against the spring contacts by a lid. The lid is clamped in place once the IC has been loaded into the socket.

Aligning and inserting or removing the IC from the socket can be difficult. Many ICs have special tools designed to assist the insertion of the IC into the socket. Even using the special tool the spring contacts may be damaged when the IC is being inserted or removed from the socket. When the spring contacts in the socket become damaged, the socket must be replaced.

DETAILED DESCRIPTION

FIGS. 1-5 and the following description depict specific examples to teach those skilled in the art how to make and use the best mode of the invention. For the purpose of teaching inventive principles, some conventional aspects have been simplified or omitted. Those skilled in the art will appreciate variations from these examples that fall within the scope of the invention. Those skilled in the art will appreciate that the features described below can be combined in various ways to form multiple variations of the invention. As a result, the invention is not limited to the specific examples described below, but only by the claims and their equivalents.

In one example embodiment of the invention, an LGA socket will have a detachable lid. The detachable lid will have a bracket attached to the lid. The IC will be mounted into the bracket and held in place with an interference fit. Once the IC has been mounted into the bracket, the lid will be installed onto the socket and clamped in place. By mounting the IC into the lid instead of inserting the IC into the socket, damage to the spring contacts in the socket may be reduced.

Figure 1A:
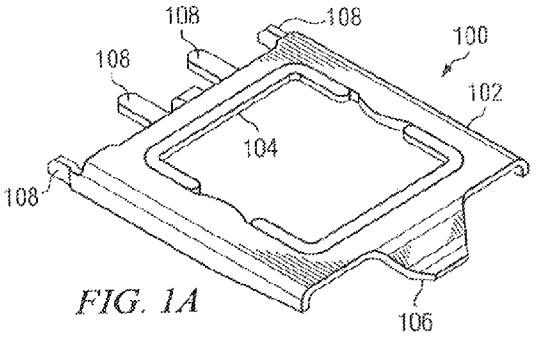
FIG. 1A is an isometric top view of a detachable lid assembly 100 in an example embodiment of the invention.

FIG. 1A is an isometric top view of a detachable lid assembly 100 in an example embodiment of the invention. Detachable lid assembly 100 comprises lid 102 and bracket 104. Lid 102 is typically fabricated from a stiff material, for example metal. Bracket 104 is fabricated from a flexible material, for example Thermal Plastic Polyurethane (TPU). Bracket 104 may be attached to lid 102 by over-molding bracket onto lid 102. In other embodiments, bracket may be configured with slots that mate with the inside edges of lid 102 to hold bracket 104 onto lid 102. Lid 102 has at least one tongue 106 that extends from one side of lid 102. Lid 102 has alignment tabs 108 extending from lid 102 on the opposite side from tongue 106.

Figure 1B:
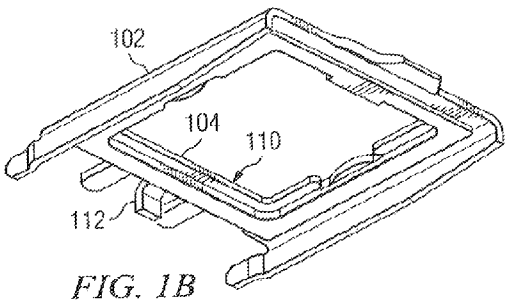
FIG. 1B is an isometric bottom view of detachable lid assembly 100 in an example embodiment of the invention.
Figure 1C:
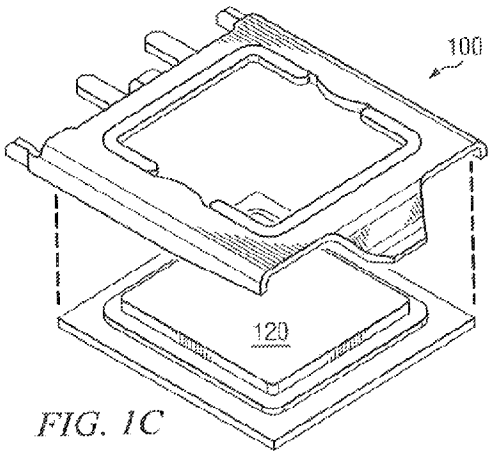
FIG. 1C is an isometric top view of detachable lid assembly 100 and IC 120 in an example embodiment of the invention.
Figure 1D:
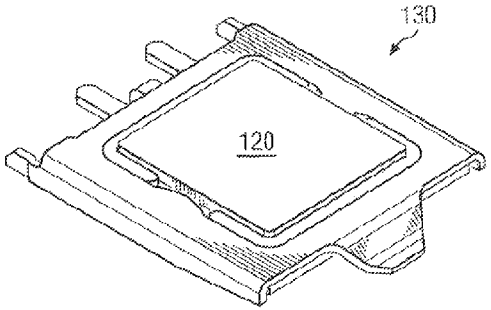
FIG. 1D is an isometric top view of a loaded lid assembly 130 in an example embodiment of the invention.

FIG. 1B is an isometric bottom view of detachable lid assembly 100 in an example embodiment of the invention. Lid 102 has secondary alignment tab 112 extending downward from lid 102 adjacent to alignment tabs 108. Bracket 104 has a recess 110 formed in the underside of bracket 104. Recess 110 is formed to mate with the outer perimeter of the IC that will be loaded into lid assembly 100. Because bracket is made with a flexible material, the IC will be held in place with an interference fit between the IC and the bracket. FIG. 1C is an isometric top view of detachable lid assembly 100 and IC 120 in an example embodiment of the invention. IC 120 may be any type of device, for example a CPU, an application specific integrated circuit (ASIC), a memory device, or the like. IC is loaded into detachable lid assembly 100 by inserting IC into bracket 104 from the bottom side of bracket 104. FIG. 1D is an isometric top view of a loaded lid assembly 130 in an example embodiment of the invention. FIG. 1D shows IC 120 loaded into detachable lid assembly 100.

Figure 2B:
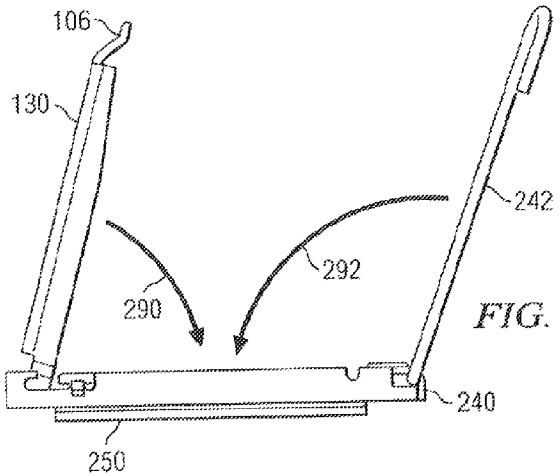
FIG. 2B is a side view of socket assembly 280 in an example embodiment of the invention.
Figure 2C:
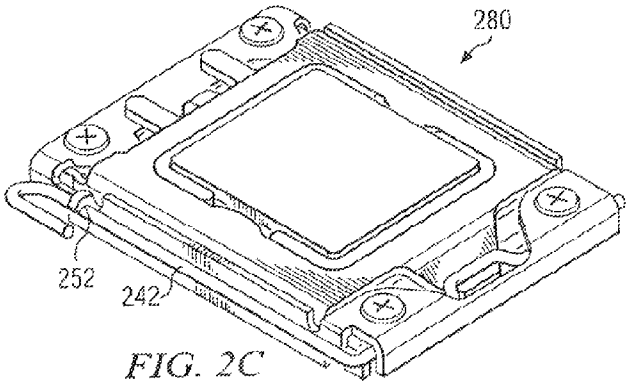
FIG. 2C is an isometric top view of the fully assembled socket assembly 280 in an example embodiment of the invention.
Figure 2A:
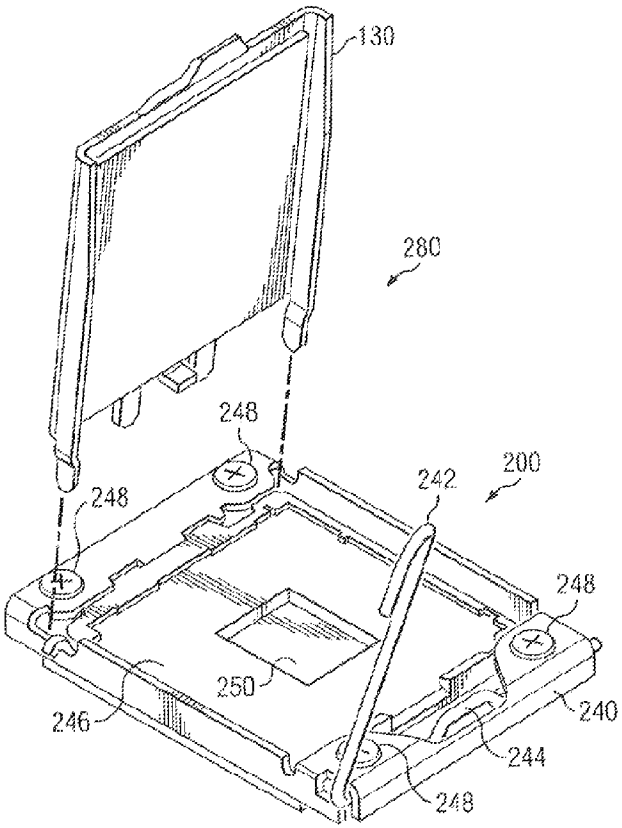
FIG. 2A is an isometric top view of socket assembly 280 in an example embodiment of the invention.

FIG. 2A is an isometric top view of socket assembly 280 in an example embodiment of the invention. Socket assembly 280 comprises lid assembly 130 with the IC installed (i.e. loaded lid 130) and socket bottom 200. Socket bottom 200 comprises frame 240, socket contacts 246, and locking lever 242. Socket bottom 200 is shown mounted to PC board 250 by 4 screws 248. Socket bottom 200 may be attached to PC board 250 using any type of fasteners. In some example embodiments of the invention, a stiffener plate (not shown) may be used on the bottom side of PC beard 250 capturing PC board 250 between the stiffener plate and the frame 240. The PC board may be the mother board for a personal computer, the processor board of a blade, the memory board of a memory system, or the like.

Loaded lid 130 is mounted or installed into socket bottom 200 by inserting alignment tabs 108 into a gap between frame 240 and socket contacts 246 as shown by the arrows. Alignment tabs 108 and secondary alignment tab 112 align loaded lid with respect to socket contacts 246 such that when loaded lid is closed the contact pads on the bottom of IC 120 align with and mate to the socket contacts 246. Locking lever 242 is shown in the open unlocked position. Locking lever 242 has locking bar 244 configured to capture and clamp tongue 106 of lid 102 when locking lever 242 is closed.

FIG. 2B is a side view of socket assembly 280 in an example embodiment of the invention. Loaded lid 130 is shown mounted into frame 240. Once loaded lid 130 is mounted into frame 240, loaded lid 130 is rotated into socket bottom as shown by arrow 290. Locking level 242 is then rotated into its closed and locked position as shown by arrow 292. As locking level is rotated from its open unlocked position into its closed locked position, locking bar 244 captures and clamps tongue 106 downwards forcing IC 120 down onto socket contacts 246. Secondary alignment tab 112 helps prevent translation of loaded lid assembly 130 as locking bar 244 rotates onto tongue 106. FIG. 2C is an isometric top view of the fully assembled socket assembly 280 in an example embodiment of the invention. Locking lever 242 may be held in its closed and locked position by hook 252 formed in the side of lid 102. In this example embodiment of the invention, a rotational motion is used to bring the contact pads on the bottom of the IC into contact with the socket contacts.

Figure 3A:
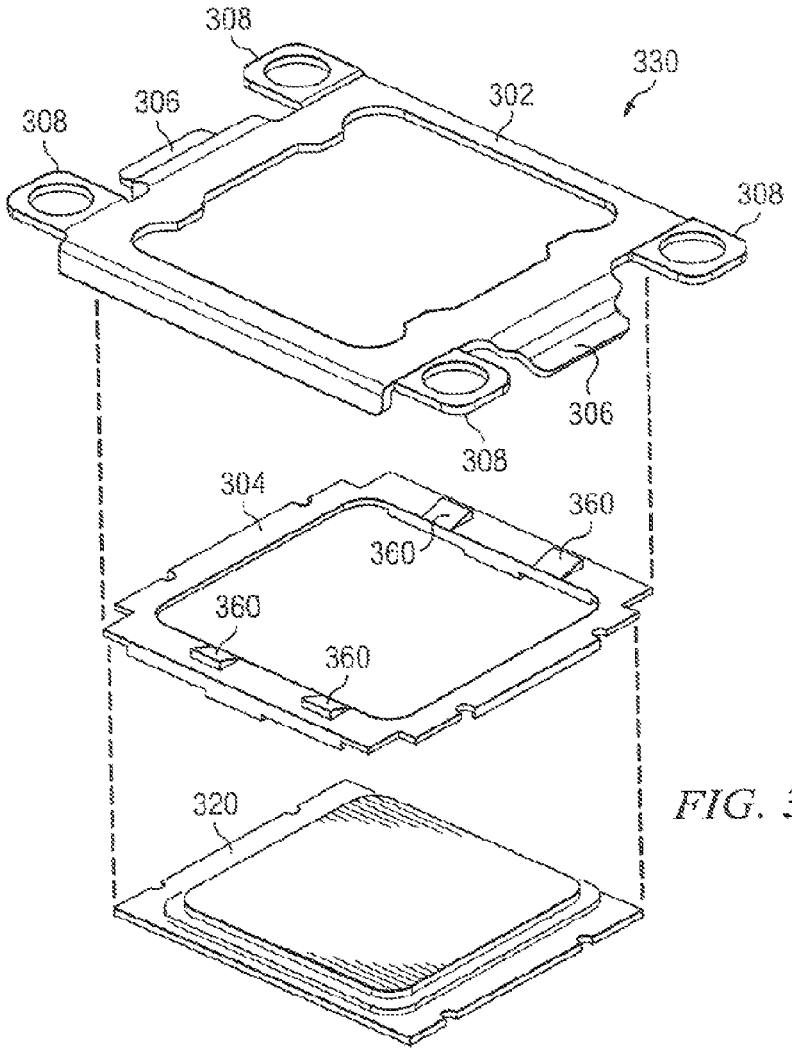
FIG. 3A is an isometric view of an assembly drawing for a loaded lid 330 in an example embodiment of the invention.

In another example embodiment of the invention, a linear motion may be used to bring the contact pads on the bottom of the IC into contact with the socket contacts. FIG. 3A is an isometric view of an assembly drawing for a loaded lid 330 in an example embodiment of the invention. Loaded lid 330 comprises lid 302, bracket 304 and IC 320. Lid 302 is typically fabricated from a stiff material, for example metal. Bracket 304 may be fabricated from a flexible material, for example Thermal Plastic Polyurethane (TPU) or a hard plastic material. When bracket is fabricated from TPU, bracket 304 may be attached to lid 302 by over-molding bracket onto lid 302. In other embodiments, bracket may be configured with snaps 360 that mate with the inside edges of lid 302 to hold bracket 304 onto lid 302. Lid 302 has two tongues 306 that extend from opposite sides of lid 302. Lid 302 has alignment tabs 308 extending from lid 302 adjacent to the two tongues 106. Each alignment tab has an alignment hole formed therein.

Figure 3B:
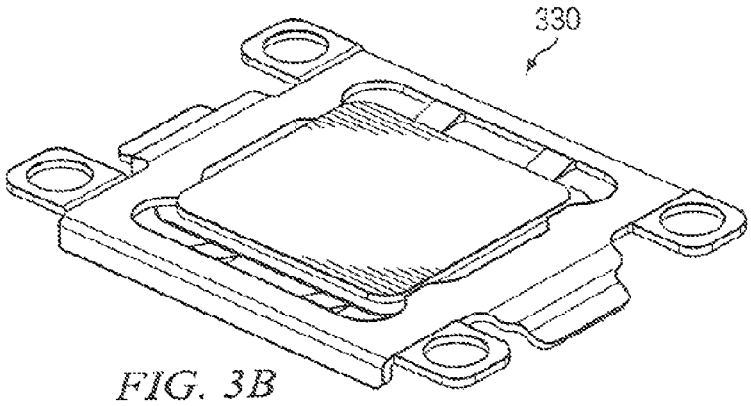
FIG. 3B is an isometric top view of a loaded lid assembly 330 in an example embodiment of the invention.

Bracket 304 has a recess formed in the underside of bracket 304 similar to recess 110. The recess is formed to mate with the outer perimeter of the IC that will be loaded into bracket 304. The IC will be held in place inside bracket 304 with an interference fit between the IC and the bracket. IC 320 may be any type of device, for example a CPU, an application specific integrated circuit (ASIC), a memory device, or the like. IC is loaded into bracket 304 by inserting IC into bracket 304 from the bottom side of bracket 304. FIG. 3B is an isometric top view of a loaded lid assembly 330 in an example embodiment of the invention. FIG. 3B shows IC 320 loaded into bracket 304 and bracket 304 installed into lid 302.

Figure 4A:
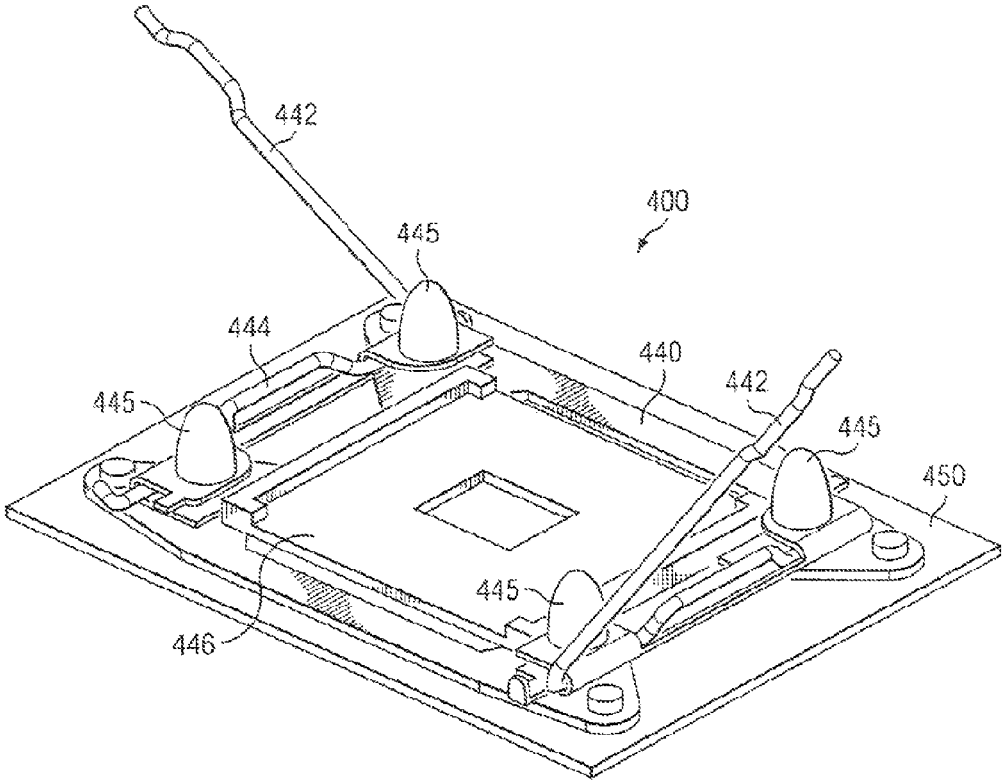
FIG. 4A is an isometric view of socket bottom 400 in an example embodiment of the invention.

FIG. 4A is an isometric view of socket bottom 400 in an example embodiment of the invention. Socket bottom 400 comprises frame 440, socket contacts 446, and locking levers 442. Socket bottom 400 is shown mounted to PC board 450. Socket bottom 400 may be attached to PC board 450 using any type of fasteners. In some example embodiments of the invention, a stiffener plate (not shown) may be used on the bottom side of PC board 450 capturing PC board 450 between the stiffener plate and the frame 440. Frame 440 has a plurality of alignment pins 445 protruding from frame 440.

Figure 4B:
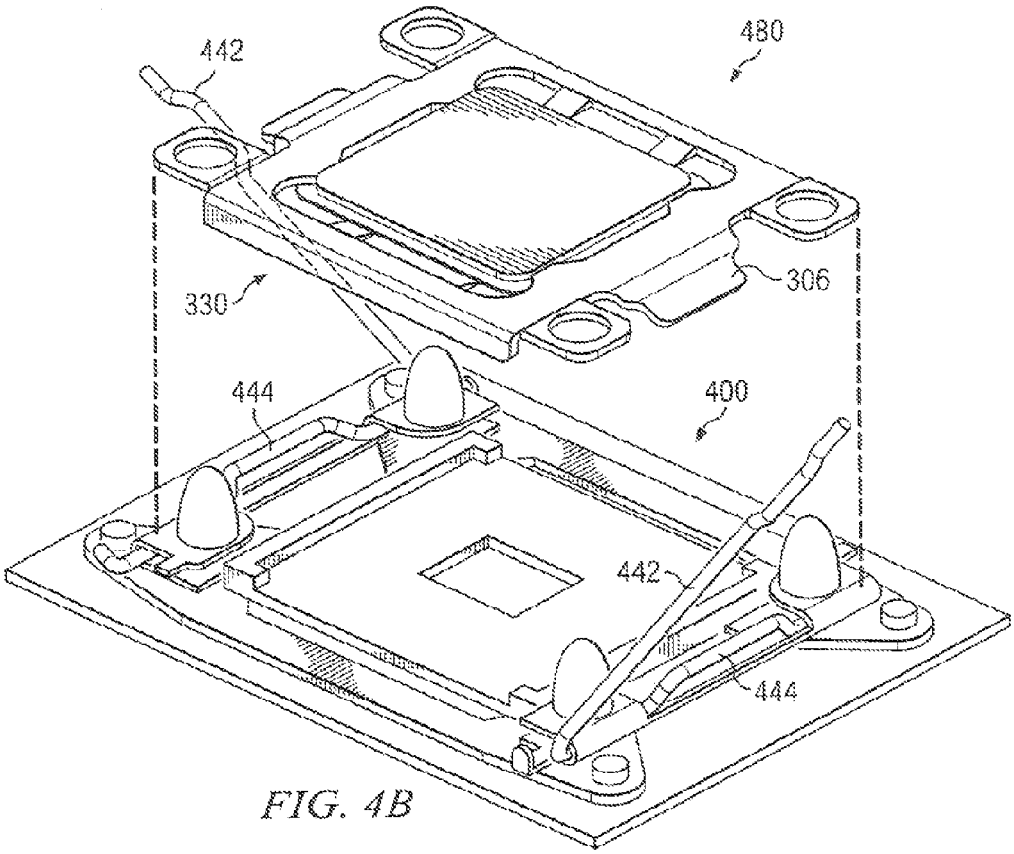
FIG. 4B is an isometric top assembly view of socket 480 in an example embodiment of the invention.
Figure 4C:
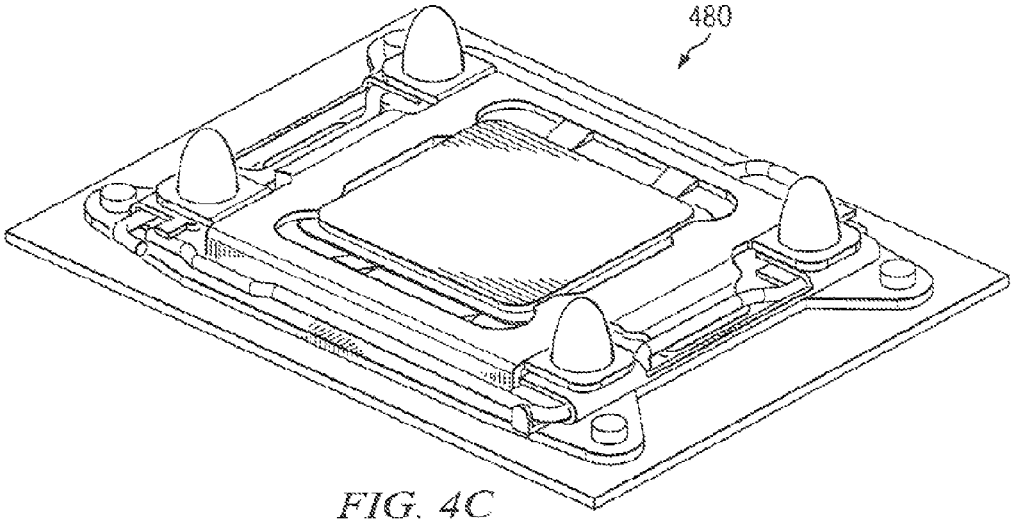
FIG. 4C is an isometric top view of the fully assembled socket 480 in an example embodiment of the invention.

FIG. 4B is an isometric top assembly view of socket 480 in an example embodiment of the invention. FIG. 4B shows loaded lid 330 positioned over socket bottom 400. Loaded lid 330 is lowered onto socket bottom 400 using a linear motion as shown by the arrows. As loaded lid 330 is lowered onto socket bottom, the alignment holes in alignment tabs 308 mate with alignment pins 445 to guide loaded lid into the correct position on socket bottom 400. Once loaded lid 300 is positioned, on top of socket bottom 400, locking levers 442 are rotated from the open unlocked position into the closed locked position. As locking levers 442 are rotated into the closed locked position, locking bars 444 capture and force tongues 306 downward, forcing the bottom of IC 320 onto socket contacts 446. FIG. 4C is an isometric top view of the folly assembled socket assembly 480 in an example embodiment of the invention.

Figure 5:
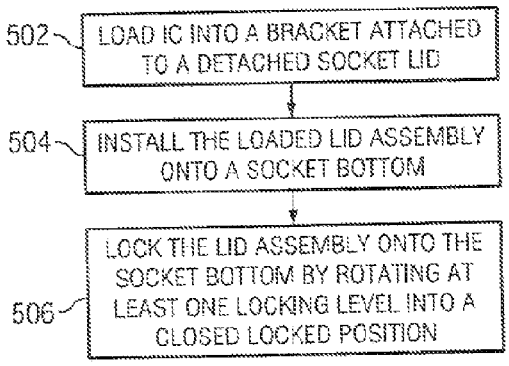
FIG. 5 is a flow chart for a method of loading an IC into a socket in an example embodiment of the invention.

FIG. 5 is a flow chart for a method of loading an IC into a socket in an example embodiment of the invention. At step 502 the IC is loaded into a bracket, attached to a detached socket lid. At step 504 the loaded lid/bracket assembly is installed into a socket bottom. At step 506 the loaded lid/bracket assembly is locked into place by moving at least one locking lever from an open unlocked position into a closed locked position.

What is claimed is:

1. An apparatus, comprising:

a frame to be attached to a primary surface of a PC board;

at least one locking lever mounted in the frame and configured to be rotated between an open unlocked position and a closed locked position;

a detachable lid, the detachable lid configured to be removably mounted onto the frame, the detachable lid having at least one tongue, wherein the detachable lid is locked onto the frame by the at least one locking lever clamping onto the at least one tongue when the detachable lid is installed in the frame and the at least one locking lever is in the closed, locked position;

a bracket attached around an inside edge of an opening in the detachable lid, the bracket configured to hold a semiconductor device in the bracket using an inference fit between the semiconductor device arid the bracket;

wherein the bracket is fabricated from a plastic material.

2. The apparatus of claim 1, further comprising:

a plurality of socket contacts attached to the frame, wherein the semiconductor device, when mounted in the bracket, is brought into contact with the plurality of socket contacts using a linear motion.

3. The apparatus of claim 1, further comprising:

a plurality of socket contacts attached to the frame, wherein the semiconductor device, when mounted in the bracket, is brought into contact with the plurality of socket contacts using a rotational motion.

4. The apparatus of claim 1, further comprising:

at least one alignment tab formed on the detachable lid, the at least one alignment tab configured to position the detachable lid with respect to the frame when the detachable lid is removably mounted onto the frame.

5. The apparatus of claim 3, further comprising:

at least one alignment pin extending from the frame and configured to mate with an alignment hole formed in each of the at least one alignment tabs formed on the detachable lid, the at least one alignment pin configured to position the detachable lid with respect to the frame when the detachable lid is removably mounted onto the frame.

6. An apparatus, comprising:

a PC board;

a frame attached to a primary surface of the PC board;

at least one locking lever mounted in the frame and configured to be rotated between, an open unlocked position and a closed locked position;

a detachable lid, the detachable lid configured to be removably installed onto the frame, the detachable lid having at least one tongue, wherein the detachable lid is locked onto the frame by the at least one locking lever damping onto the at least one tongue when the detachable lid. is installed, in. the frame and the at least one locking lever is in the closed locked position;

a bracket attached around an inside edge of an opening in the detachable lid;

a semiconductor device; the semiconductor device mounted in the bracket using an inference fit between the semiconductor device and the bracket;

wherein the bracket is fabricated from a plastic material.

7. The apparatus of claim 6, wherein the semiconductor device is a land grid array (LGA) type CPU.

8. The apparatus of claim 6, wherein the PC board is a processor board for a blade.

9. The apparatus of claim 6, further comprising:

at least one alignment tab formed on the detachable lid, the at least one alignment tab configured to position the detachable lid with respect to the frame when the detachable lid is removably mounted onto the frame.

10. The apparatus of claim 9, further comprising:

at least one alignment pin extending from the frame and configured to mate with an alignment hole formed in each of the at least one alignment tabs formed on the detachable lid, the at least one alignment pin configured to position the detachable lid with respect to the frame when the detachable lid is removably mounted onto the frame.

* * * * *

UNITED STATES PATENT AND TRADEMARK OFFICE

CERTIFICATE OF CORRECTION

PATENT NO. : 9,011,170 B2
APPLICATION NO. : 13/823916
DATED : April 21, 2015
INVENTOR(S) : Keith A. Sauer et al.

It is certified that error appears in the above-identified patent and that said Letters Patent is hereby corrected as shown below:

In the Claims

In column 4, line 29, in Claim 1, delete “arid” and insert -- and --, therefor.

In column 4, line 46, in Claim 5, delete “3,” and insert -- 4, --, therefor.

In column 4, line 64, in Claim 6, delete “damping” and insert -- clamping --, therefor.

In column 4, line 65, in Claim 6, delete “lid.” and insert -- lid --, therefor.

In column 4, line 65, in Claim 6, delete “installed, in.” and insert -- installed in --, therefor.

Signed and Sealed this
Twenty-ninth Day of September, 2015

Michelle K. Lee

Michelle K. Lee
*Director of the United States Patent and Trademark Office*